US005240346A

United States Patent [19]

Yin

[11] Patent Number: 5,240,346

[45] Date of Patent: Aug. 31, 1993

[54] MANHOLE HAVING A SPLAYED RIB RING FORMED AT UNDERSIDE OF THE LID THEREOF

[76] Inventor: Chun-Chou Yin, 20, Fu Hsin Hsin Tsun, Kuo Kuang Li, Hwa Lian City, Hwa Lian County, Taiwan

[21] Appl. No.: 831,567

[22] Filed: Feb. 5, 1992

[51] Int. Cl.[5] ..... E01C 29/14

[52] U.S. Cl. ..... 404/25; 52/20

[58] Field of Search ..... 404/25, 26; 52/20

[56] References Cited

U.S. PATENT DOCUMENTS

| | | | |
|---|---|---|---|
| 3,308,727 | 3/1967 | Hurt, Jr. | 404/25 X |
| 4,763,449 | 8/1988 | Vigneron et al. | 404/25 X |
| 4,934,715 | 6/1990 | Johnson | 404/25 X |
| 5,082,392 | 1/1992 | Marchese et al. | 404/25 |

*Primary Examiner*—William P. Neuder
*Attorney, Agent, or Firm*—Bacon & Thomas

[57] ABSTRACT

A manhole having a splayed rib ring extending from under a lid, an annular supporter having a beveled underside extending around the opening of a ring seat, and an insulation hood attached to an inner side of the splayed rib ring. Both the splayed rib ring and the annular supporter may or may not be concentric with the lid or the ring seat, respectively. Vibration and possible bouncing of the lid is reduced or offset because the splayed rib ring of the lid is retained by the bevelled underside of the annular supporter. A half round groove formed around an outer bottom periphery of the lid accommodates a rubber gasket which prevents the lid from directly contacting the annular supporter, and absorbs and relieves vibration of the lid to reduce the possible noise. The insulation hood completely prevents any worn cables under the manhole from directly contacting the lid and therefore, prevents any possible leakage via the lid that might endanger vehicles and walkers passing by the manhole.

9 Claims, 10 Drawing Sheets

MANHOLE HAVING A SPLAYED RIB RING FORMED AT UNDERSIDE OF THE LID THEREOF

BACKGROUND OF THE INVENTION

The present invention relates to a manhole, particularly to a manhole of which the lid is provided with a underside splayed rib ring and the ring seat is provided with a generally annular supporter having a bevelled underside. When the lid is vertically or diagonally placed over the ring seat, the splayed rib ring of the lid extends down beyond the ring seat and also the annular supporter of the ring seat. In the event the lid is lifted or removed in a non-vertical direction, the splayed rib ring is retained by the annular supporter.

Presently, there are various and numerous piping and drainage conduits set up underground and manholes for culverts of gas, running water, power cable, communication cable, military communication cable, underground drainage, etc. can be seen everywhere on the surface of the roads and bridges. However, these manholes are usually improperly designed and therefore, their lids frequently vibrate or bounce when they are run over by vehicles of high weight and/or travelling at very high speed. A vibrating or bounding manhole lid creates undesirable noise and can, sometimes, even bounce out of place to endanger nearby buildings, walkers, or vehicles, resulting in serious accidents and losses. In view of this, an improved manhole is needed to ensure safety.

The bounding out of place of a manhole lid may be attributable to the following causes:

1. The peripheries of currently used manhole lid 1*a* and ring seat 2*a*, as shown in FIGS. 13 and 14, are usually concentric and have too big a gap between them, while low manufacturing precision further enlarges this gap. This enlarged gap usually allows the vibration and bouncing of the manhole lid;

2. The rubber gasket 3*a* used for the known manhole lid 1*a* is usually provided at a place somewhat distant from the outer edge of the lid 1*a* and thereby, inevitably forms a fulcrum for pivoting thereof. Whenever one side of the outer edge of the lid 1*a* is subjected to a force, the opposite side thereof is raised due to leverage with the gasket 3*a* as the fulcrum. Due to its high speed, a vehicle may immediately run over the raised side. The impact of vehicle on the already raised side of a manhole lid 1*a* causes the first run over side to raise even higher. The wind pressure may cause a vacuum suction to form at the same time, as described in next paragraph, which further causes the lid 1*a* to bounce out of place;

3. A vacuum will form nearby the manhole lid 1*a* in the instance when a vehicle runs over the lid, which causes the pressure on the surface of lid 1*a* to be abruptly reduced and the lid 1*a* will raise because of the pressure imbalance below and above the lid 1*a*. At the same time, surrounding air with higher density flows toward the point being run over by the vehicle which causes an increase in wind pressure. The faster the vehicle speed, the stronger the wind pressure and the suction vacuum. The wind pressure and the suction force will move forward following the speedy movement of the vehicle. All of these forces form a resultant force in normal direction that lifts the manhole lid 1*a*; and, 4. Since the peripheries of the lid 1*a* and the ring seat 2*a* are usually concentric with each other and have the same gradiant in the same direction, no resistance forms when the lid 1*a* is raised from the ring seat 2*a* at the time it is run over by a vehicle. This situation, plus the above mentioned state which forms an upward suction and the wind pressure caused by surrounding air flowing toward the lid 1*a*, further helps the lid 1*a* to bounce and even fly out of place.

In addition to the noise and possible damages caused by a bouncing and even flying out of the manhole lid, there are two other disadvantages found in existing manholes:

1. Since the quality of an existing manhole is largely dependent on the manufacturing precision of the present device, it is necessary to inspect and accept the manholes as a set, that is, a lid 1*a* must be used together with its matched ring seat 2*a* and cannot be conveniently replaced by other ones. This obviously causes much unnecessary trouble in practical use, maintenance, transportation, and storage of manholes. To replace the original lid 1*a* with another lid might very possibly lose the match of the lid 1*a* with the ring seat 2*a* and thereby worsen the bounce situation.

2. Furthermore, most of the existing manholes are made of cast metal which is electrically conductive. When the cables under the manhole become worn out, a leakage might occur when the conductive wire in the cable contacts the metal lid 1*a* or ring seat 2*a*. For a power cable of high voltage, explosion or shock might cause serious injury, damage, loss, or even death.

There is a need for a manhole with a diagonally retained lid, which is simply structured, easily manipulable, requires a lower-precision in manufacture, and which can prevent the manhole lid from bouncing out of place, emitting noise, and causing leakage.

SUMMARY OF THE INVENTION

It is a primary object of the present invention to provide a manhole in which the lid will not emit noise due to vibration nor bounce out of place due to the vacuum caused by being run over by a vehicle at high speed.

Another object of the present invention is to provide a manhole, of which the lid or the ring seat can be freely replaced by others without causing vibration or bounce resulting from increased gap between the lid and the ring seat.

A further object of the present invention is to provide a manhole, with which leakage or accident will not occur due to worn out cables under the manhole directly contacting the lid or the ring seat.

It is still a further object of the present invention to provide a manhole of which the lid is easily manipulable by lifting manually without using bulky or heavy hoist or other lifting means.

Briefly, the present invention is a manhole suitable for use on road and bridge surfaces. It can be custom designed in size and located without emitting noise. What is most important is that the lid will not bounce out place when it is run over by a vehicle at high speed, nor is it conductive when electrical cables under the manhole become worn out and directly contact the lid or the ring seat of the manhole.

BRIEFLY DESCRIPTION OF THE DRAWINGS

The present invention can be better understood by referring to the following detailed description of the preferred embodiments and the accompanying drawings wherein.

Figure 4:
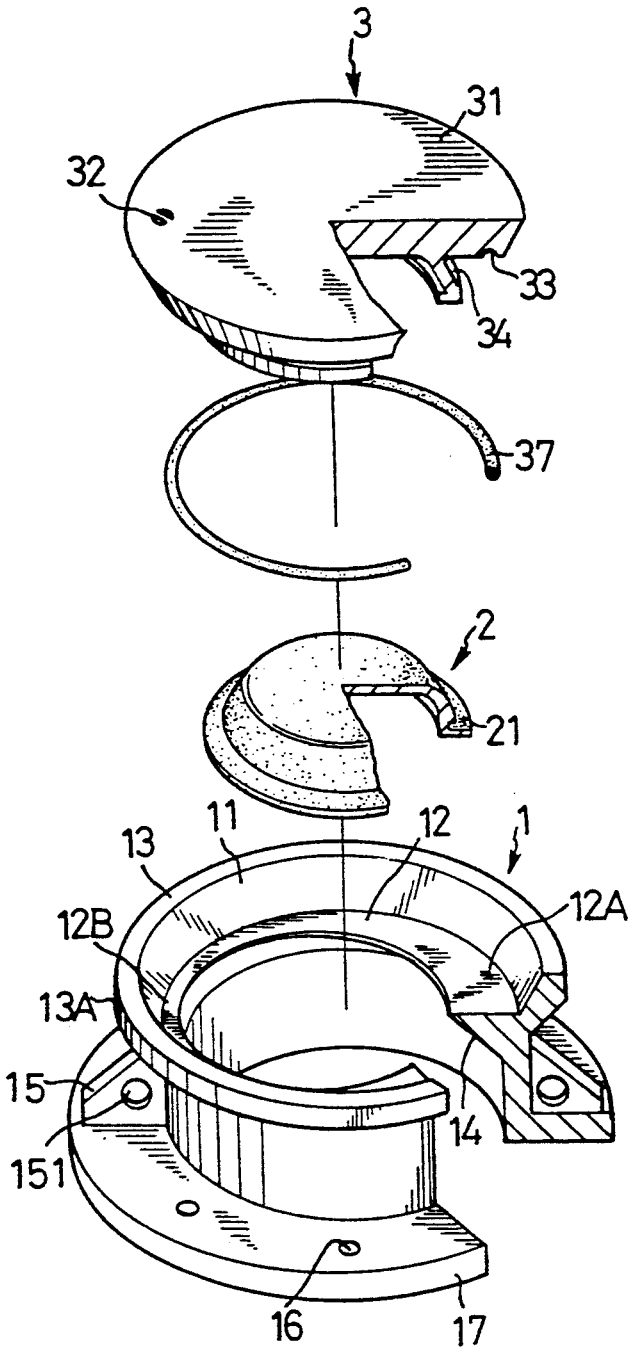
FIG. 4 is an exploded perspective view of a second embodiment of the present invention, showing a round manhole of which the ring seat is not concentric with its underside-bevelled annular supporter.
Figure 5:
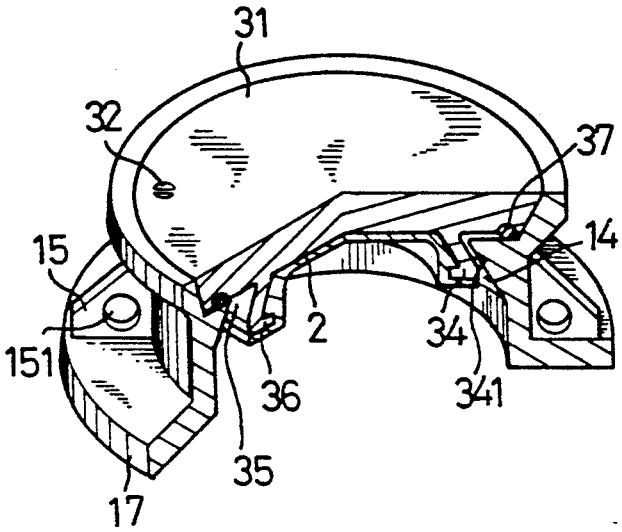
FIG. 5 is a perspective view, partially broken away of the embodiment of the present invention shown in FIG. 4.
Figure 6:
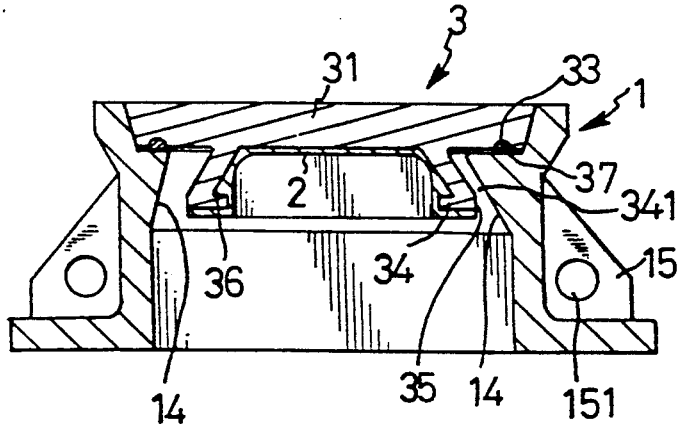
FIG. 6 is a cross-sectional view of the embodiment of the present invention shown in FIGS. 4 and 5, showing the relation of the lid to the ring seat.
Figure 11A:
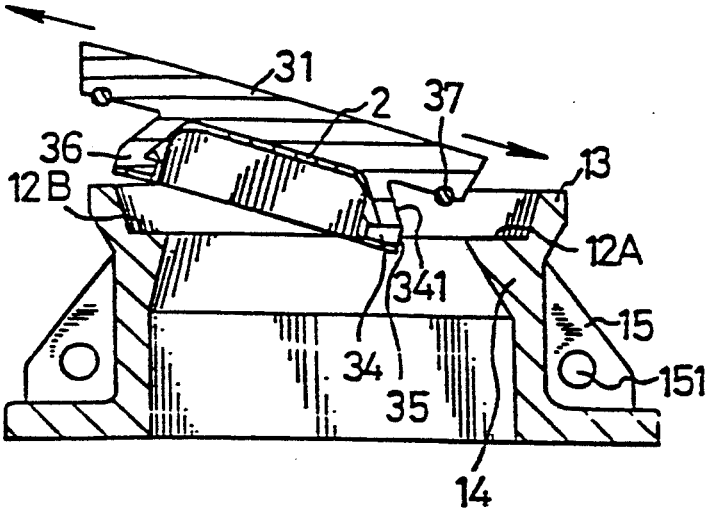
Figure 11B:
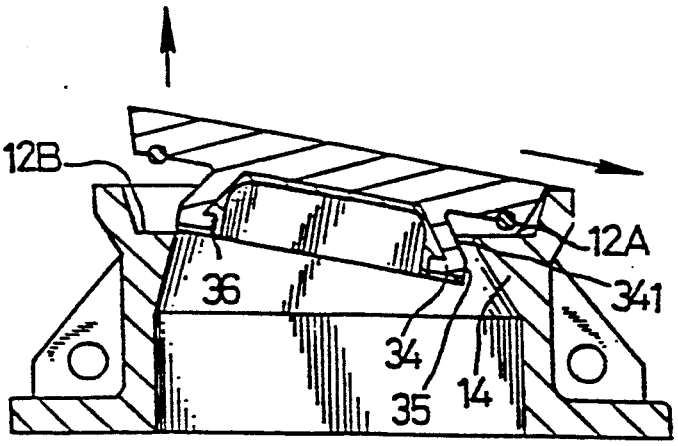
Figure 11C:
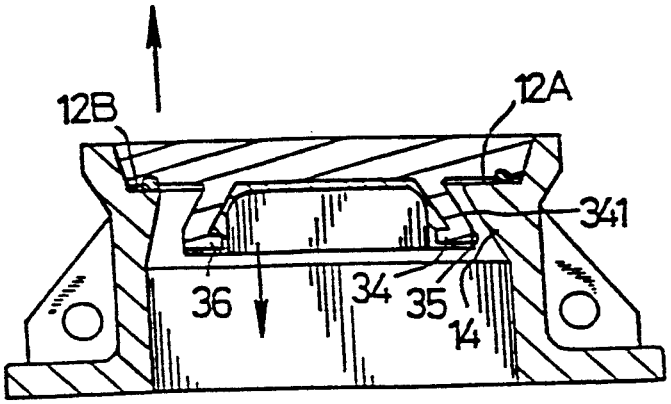
Figure 13:
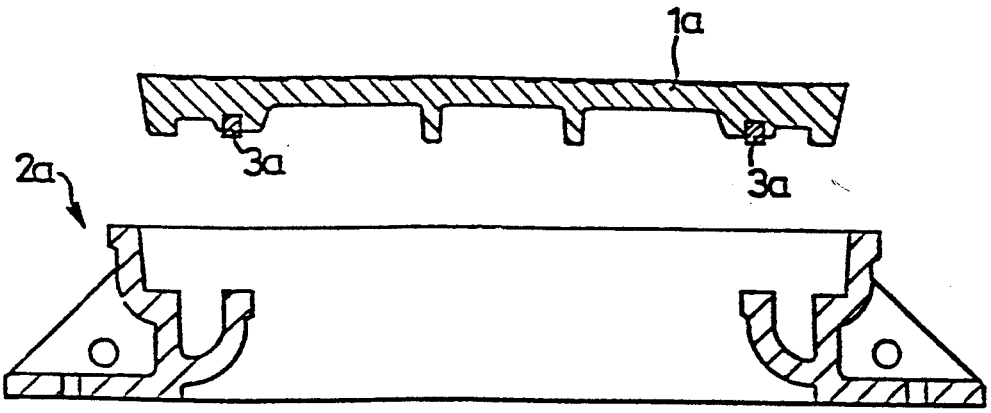
FIG. 13 (PRIOR ART)
Figure 14:
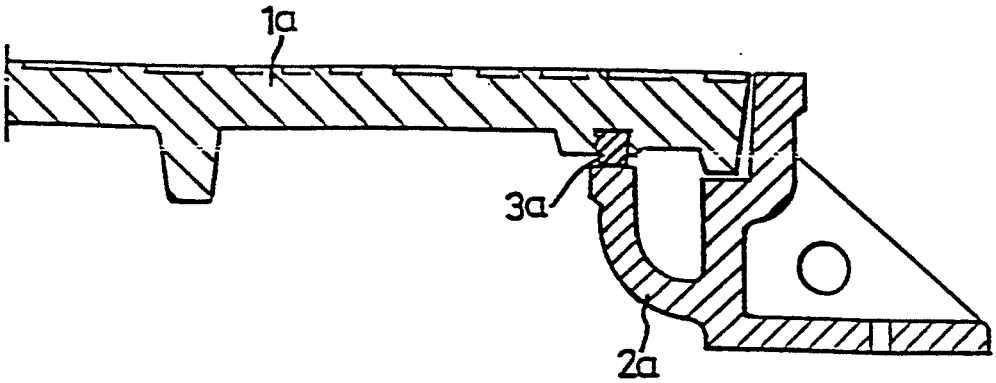
FIG. 14 (PRIOR ART)

FIGS. 11A, 11B, and 11C are cross-sectional views illustrating the manipulation of the lid and the ring seat of the second embodiment of the present invention shown in FIGS. 4, 5 and 6;

FIGS. 12A, 12B, 12C, and 12D are cross-sectional views illustrating how the lid of the present invention is retained by the ring seat when it is lifted;

FIG. 13 is a cross-sectional view showing the structure of a conventional manhole; and FIG. 14 is a partial, enlarged, cross-sectional view of the conventional manhole, showing the positional relationship of the lid to the ring seat thereof.

DETAILED DESCRIPTION OF THE PREFERRED EMBODIMENTS

Figure 1:
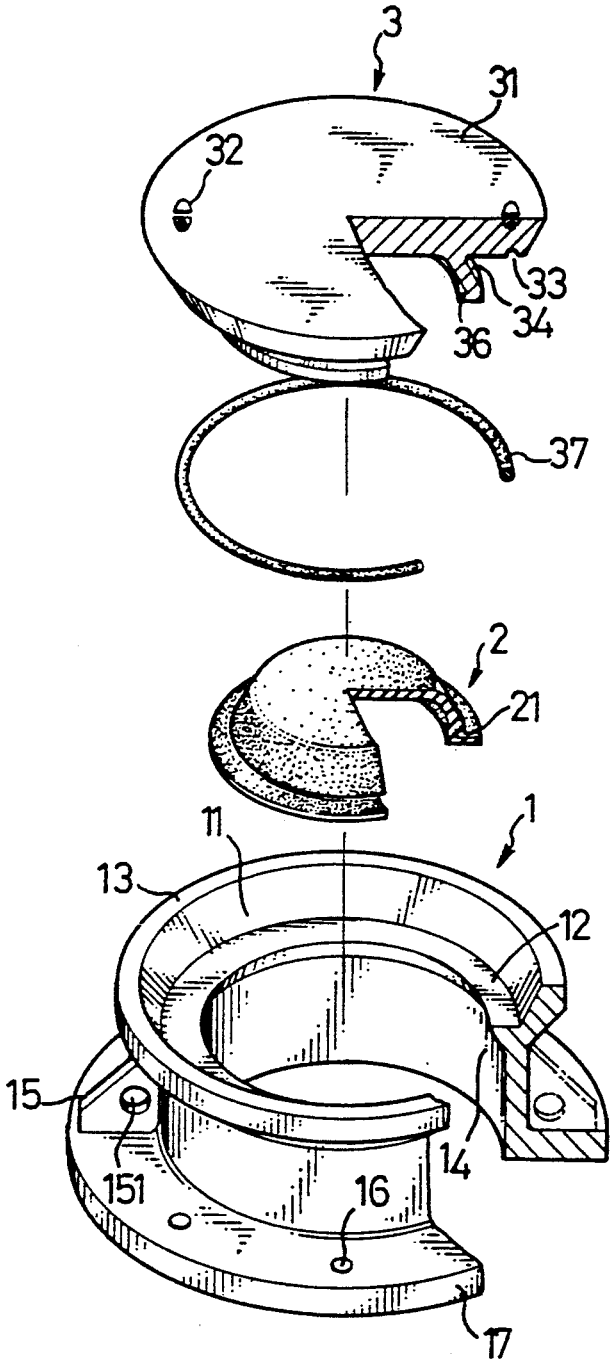
FIG. 1 is an exploded perspective view of an embodiment of the present invention, showing a round manhole of which the ring seat is concentric with an underside-bevelled annular supporter thereof.

Please refer to FIG. 1 in which a manhole characterized by a concentric annular supporter on a ring seat is shown. The manhole mainly comprises a ring seat 1, an insulation hood, a lid 3, and a rubber gasket 37. The ring seat 1 and the lid 3 are generally made of cast iron, such as nodular cast iron or other cast material with higher strength. The ring seat 1 further consists of a lid-receiving portion 11 which has a concentrically formed annular supporter 12, an annular top 13, and a bottom flange 17. The annular supporter 12 is formed with an outward and downward bevelled underside 14. A plurality of stiffening ribs 15 each with a centered lifting eye 151 are equally spaced on the bottom flange 17 and attach to the vertical wall between the annular top 13 and the bottom flange 17. A plurality of mounting holes 16 are formed in the bottom flange 17 for mounting and fixing the ring seat 1 onto the ground or a receiving member of the underground conduit system.

The lid 3 is designed to be received by the lid-receiving portion 11 on the annular supporter 12 of the ring seat 1 so that top 31 of the lid 3 is flush with the annular top 13 when the lid 3 completely covers the lid-receiving portion 11. A circular splayed rib ring 34 is formed under and near the outer periphery of the lid top 31 which extends outwardly and downwardly to the extent that its outer diameter is slightly smaller than the inner diameter of the annular supporter 12. The splayed rib ring 34 has a vertical retaining part 35 formed at its lower outer end facing the inner wall of the ring seat 1, and a set flange 36 formed at a lower inner end extending in a direction opposite to the vertical retaining part 35 for engaging a fixing groove 21 formed on the insulation hood 2, thereby permitting the insulation hood 2 to be fixedly attached to inner side of the lid 3. A circular half-round groove 33 is formed on the underside and near the periphery of the lid 3 so that it is located on the span of top surface of the annular supporter 12 and permits the rubber gasket 37 to firmly inserted into it.

Figure 2:
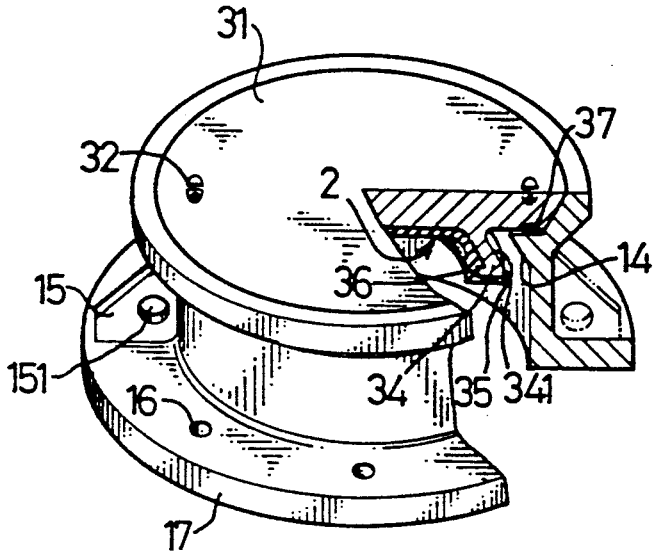
FIG. 2 is a perspective view, partially broken away, of the embodiment of the present invention shown in FIG. 1.
Figure 3:
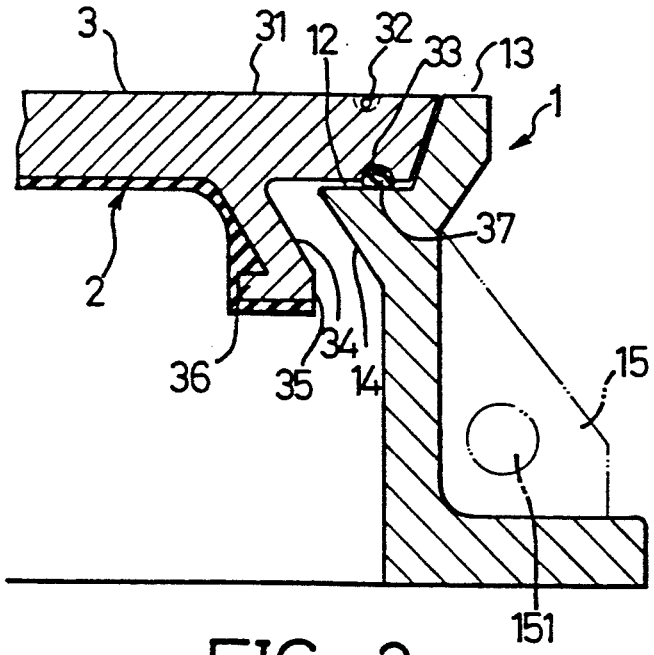
FIG. 3 is a partial, enlarged, cross-sectional view of the embodiment of the present invention shown in FIGS. 1 and 2, showing the relation of the lid to the ring seat.

Please refer to FIGS. 2 and 3 for the relationship of the lid 3 to the ring seat 1 after the lid 3 is placed onto the annular supporter 12. As shown in the figures, the whole weight of the lid 3 falls onto the annular supporter 12 through the rubber gasket 37.

Now, referring to FIGS. 4, 5 and 6 in which a second embodiment of the present invention characterized by an eccentric annular supporter of the ring seat is shown. All the referencing numbers used in these figures are the same as that used in FIGS. 1, 2 and 3 for the corresponding parts, except that 12A is added to indicate the annular supporter side with larger width and 12B is added to indicate the annular supporter side with smaller width. The difference in the width of the annular supporter 12 exists because the annular supporter 12 has different center from that of the ring seat 1. The width of the annular supporter side 12B is smaller and gradually becomes larger toward the annular supporter side 12A, then, the larger width at the annular supporter side 12A gradually becomes smaller toward the annular supporter side 12B. An arrow indicator 13A is stamped on the annular top 13 at a position near the smaller width annular supporter side 12B to facilitate the lifting of the lid 3. When the lid 3 is placed on the ring seat 1, a larger part of the splayed rib ring 34 of the lid 3 is retained by the bevelled underside 14 of the ring seat 1 at the larger width annular supporter side 12A. Whenever the center the lid 3 or the edge of the lid 3 near the larger width annular supporter side 12A is subjected to an upward normal pull force, the lid 3 will not bounce because its splayed rib ring 34 is retained by the bevelled underside 14. Similarly, the splayed rib ring 34 can be designed to be eccentric from the lid 3 corresponding to the eccentric annular supporter 12. A manhole with such an eccentric splayed rib ring 34 and eccentric annular supporter 12 will have the same function and manipulation method as that provided by a manhole with concentric splayed rib ring 34 and concentric annular supporter 12, except that the former may further have a locating effect.

Figure 7:
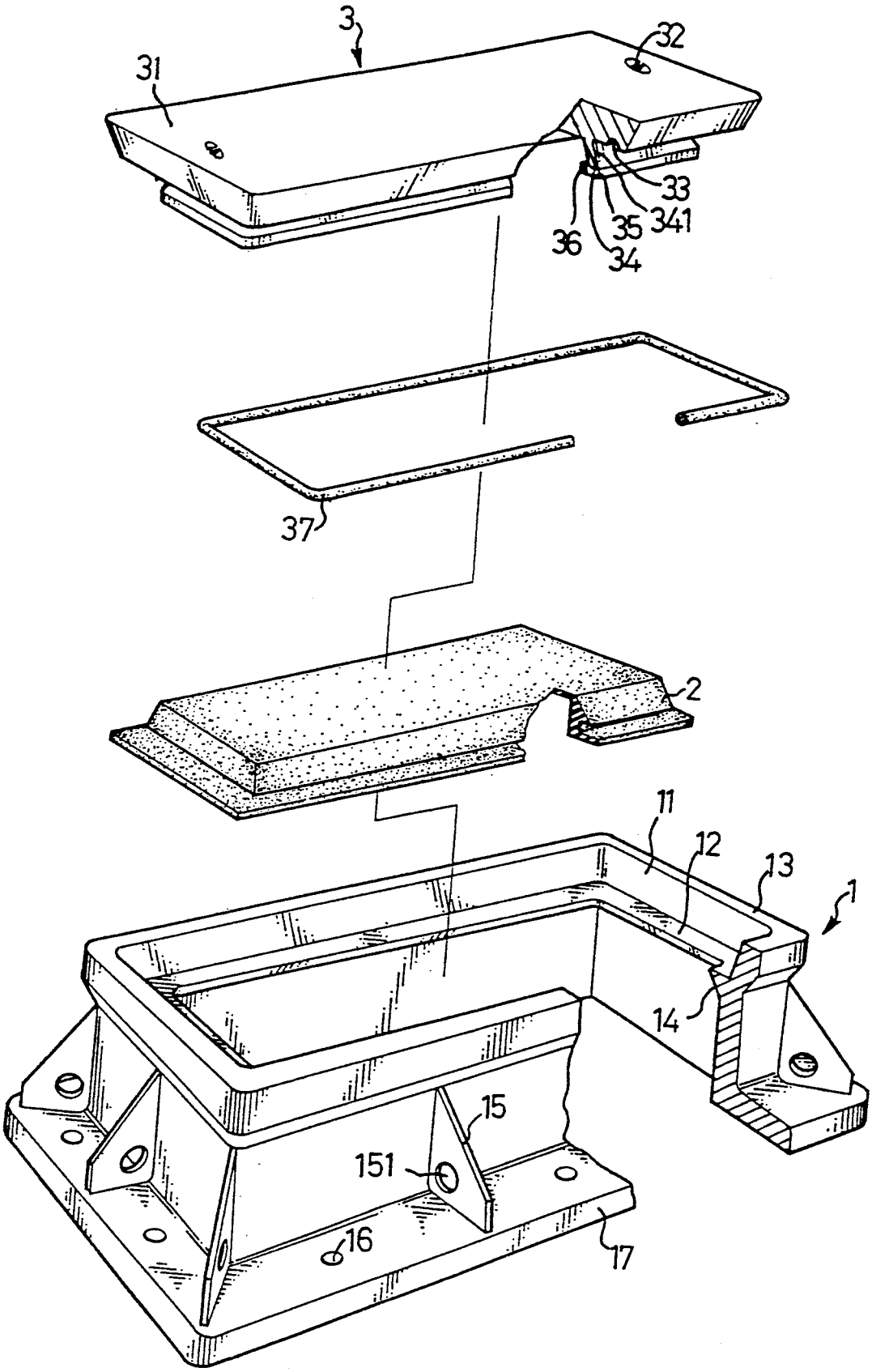
FIG. 7 is an exploded perspective view of a third embodiment of the present invention.
Figure 8:
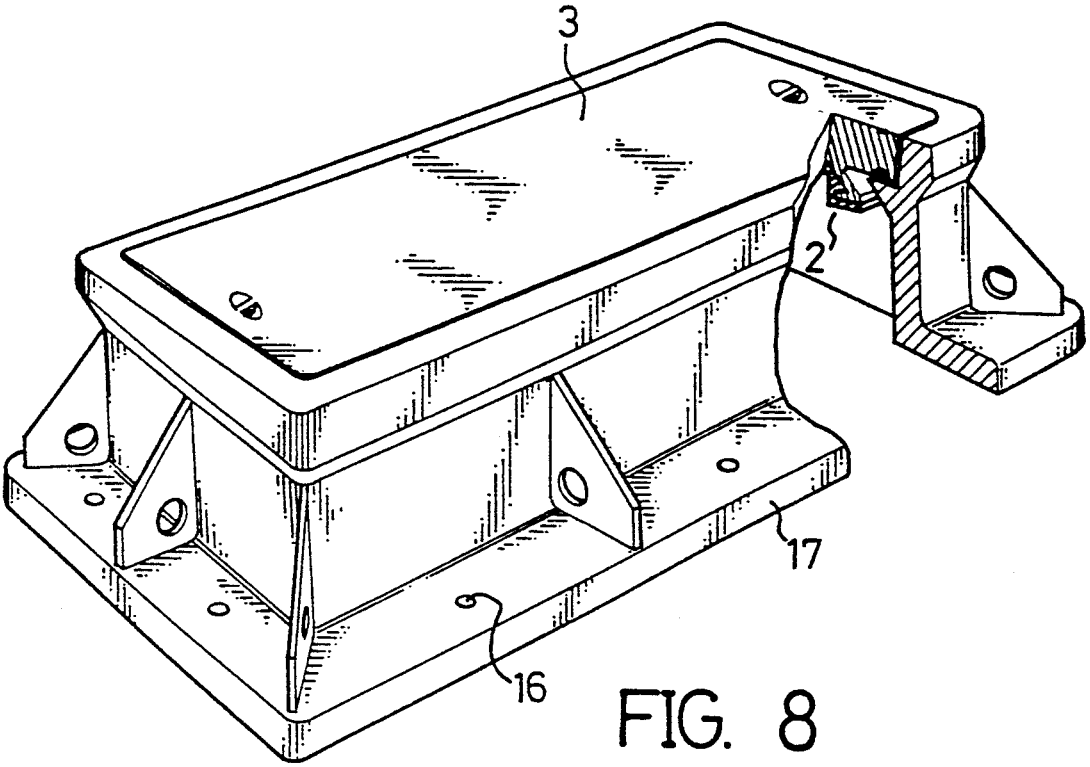
FIG. 8 is a perspective view, partially broken away of the embodiment of the present invention shown in FIG. 7.
Figure 9:
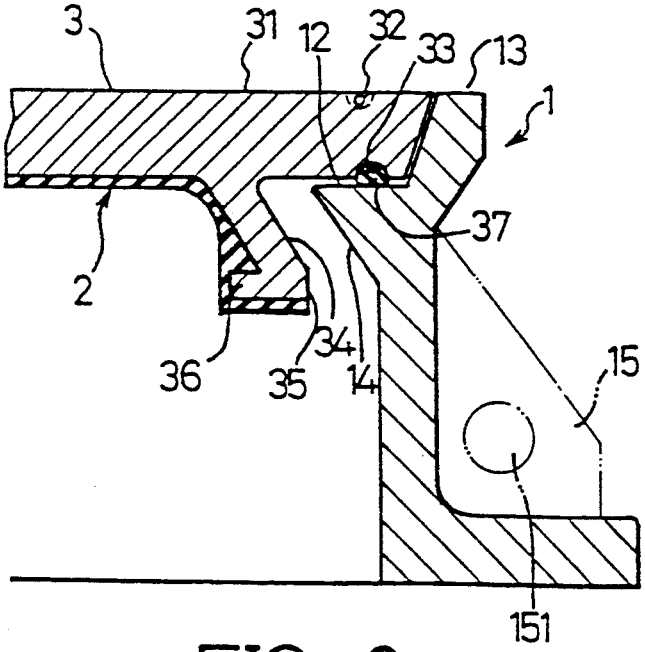
FIG. 9 is a partial, enlarged, cross-sectional view of the embodiment of the present invention shown in FIGS. 7 and 8, showing the relation of the lid to the ring seat.

Further refer to FIGS. 7, 8 and 9 in which a third embodiment of the present invention is shown, wherein the referencing numbers are used in the figures are the sane as that used in FIGS. 1, 2, and 3, as well as in FIGS. 4, 5 and 6 for the corresponding parts. This third embodiment has exactly the same function and objects as that provided by the first and the second embodiments, the only difference between them are their shapes.

The present invention may be further designed to have a supporter 12 in an elliptical shape (not shown)

and a corresponding elliptical splayed rib ring 34. With this design, the retained area of the splayed rib ring 34 by the bevelled underside 14 of the ring seat 1, as well as the firmness of such retaining is increased and thereby, provides the same or better effect than that provided by the previously described embodiments.

From this point of view, it can be seen that the present invention may be applied to a wide range of applications and, the above illustrated shapes of the invention shall not be used to limit the invention itself; any product having similar structure or characteristics to that of the present invention shall be included in the scope of the present invention.

Please now refer to FIGS. 10 to 12, in which the manipulation of the lifting and closing of the lid 3 of the present invention as well as the manner in which the lid 3 is prevented from bouncing out of place are illustrated in detail.

Figure 10A:
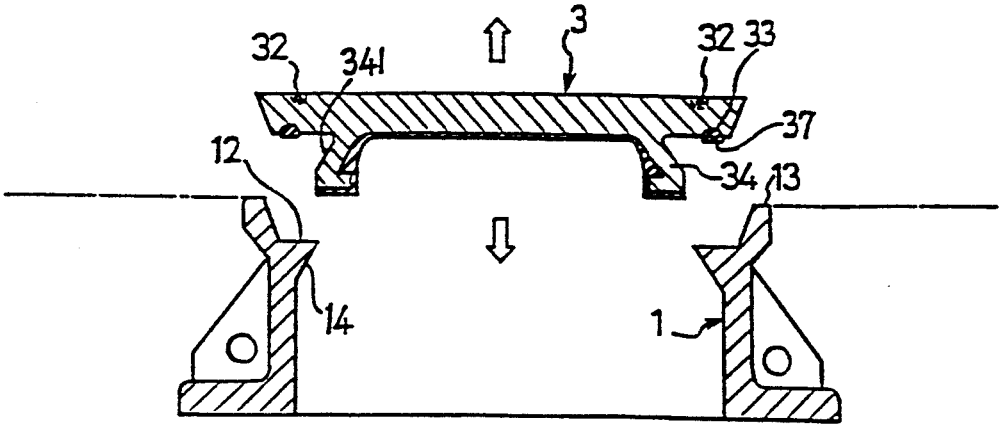
FIGS. 10A and 10B are cross-sectional view illustrating the manipulation of the lid and the ring seat of the first embodiment of the present invention shown in FIGS. 1, 2 and 3.
Figure 10B:
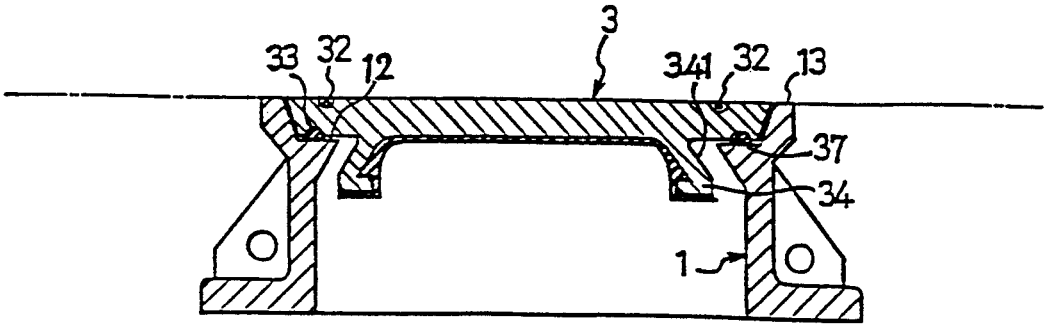

For a manhole having concentric annular supporter 12; in order to close the lid 3, first lift the same to top of the ring seat 1 by using lid pick-up holes 32 at opposite sides of the lid 3 (as shown in FIG. 10A), then slowly put down the lid 3 onto the lid-receiving portion 11 of the ring seat 1 in a direction normal to the ring seat 1 (as shown in FIG. 10B), permitting the lid 3 to seat steadily on the annular supporter 12 of the ring seat 1.

To remove the lid 3, first hook the lid pick-up holes 32 on the lid 3 with hooking means (as shown in FIG. 10B), then vertically lift the lid 3 upward until the splayed rib ring 34 under the lid 3 goes beyond the annular top 13 of the ring seat 1 (as shown in FIG. 10A). Finally, put the removed lid 3 aside.

For a manhole having an eccentric annular supporter 12: in order to close the lid 3, first pull the same toward the ring seat 1 by using one of the lid pick-up holes 32. This causes the lid 3 to be diagonally directed into the lid-receiving portion 11 as shown in FIG. 11A, while pulling the lid 3 in a direction as shown by the dotted line on the drawing until about half of the splayed rib ring 34 extends toward and down beyond the bevelled underside 14 of the larger width annular supporter side 12A as shown in FIG. 11B. Since the other half circle of the splayed rib ring 34 near the smaller width annular supporter side 12B is not subjected to any hindrance, it can be directly located onto the annular supporter 12, causing the ring seat 1 to be completely closed, as shown in FIG. 11C.

To remove the lid 3, first hook the lid pick-up hole 32 near the arrow indicator 13A on the annular top 13 with a hooking means, then, lift the lid 3 in a direction as shown by the solid arrow on FIG. 11C until the splayed rib ring 34 of the lifted side passes out of the smaller width annular supporter side 12B as shown in FIG. 11B. Finally, diagonally pull the lid 3 in a direction shown by the solid arrow as shown in FIG. 11A until the lid 3 completely passes out of the ring seat 1.

Advantages available from the manhole according to the present invention are:

1. The lid 3 is prevented from bouncing out of the ring seat 1.

Figure 12A:
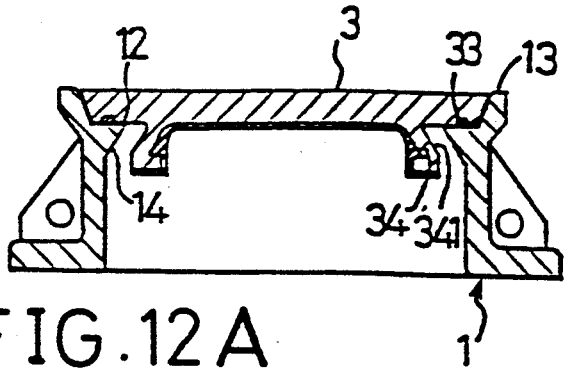

Please refer to FIG. 12A. When the lid 3 is closed onto the ring seat 1, the splayed rib ring 34 extends down beyond the annular supporter 12 with its outer bevel 341 parallel to the bevelled underside 14 of the annular supporter 12. Since the outer diameter of the splayed rib ring 34 is slightly smaller than the inner diameter of the annular supporter 12, the lid 3 must be closed or removed in a direction normal to the ring seat 1. In any movement causing the lid 3 to be away from the center line or to be inclined, the splayed rib ring 34 of the lid 3 will easily touch and thereby be stopped by annular supporter 12 from uncovering or leaving the ring seat 1.

Figure 12B:
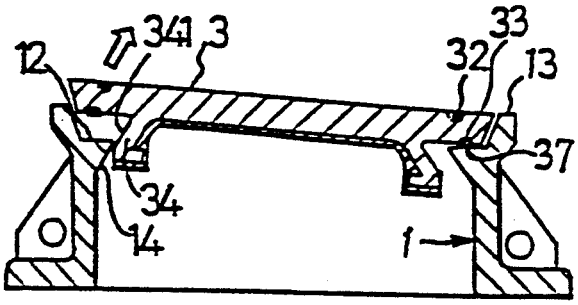

As shown in FIG. 12B, when the lid 3 is pulled upwardly by using only one lid pick-up hole 32, the slant of the lid 3 will cause an outer bevel 341 of the splayed rib ring 34 to be retained by the bevelled underside 14 of the annular supporter 12 because the splayed rib ring 34 moves away from the center line of the ring seat 1. Similarly, when a vehicle runs over or passes the lid 3, the resulting forces, such as the upward suction, wind pressure, and bounce force generated from the improper fulcrum, etc., will follow the travelling direction of the vehicle, that is, form a forward and generally horizontal resultant force that will very possibly lift eh lid 3 in a diagonal direction. According to the analysis in the previous part of this paragraph, the lid 3 would be retained by the annular supporter 12 of the ring seat 1 and thereby be prevented from bouncing out of place.

Furthermore, since the rubber gasket 37 is inserted into a half round groove 33 which is located at a position much closer to the periphery of the lid 3 than the conventional manholes, this position of the rubber gasket 37 also eliminates the possible bounce of the lid 3 because the gasket 37 does not form a leverage fulcrum when a vehicle runs over the edge of lid 3.

Since the splayed rib ring 34 of the lid 3 extends down beyond the annular supporter 12 of the ring seat 1 when the lid 3 is in place, there is no gap between the lid 3 and the annular supporter 12 to allow the wind pressure caused by running over vehicles to directly push the lid 3 and lift the same away from its place. In the event any wind force will pass the lid 3 and reach the outer bevel 341 of the splayed rib ring 34, it will result in a downward force, plus the weight of the lid 3 itself, will prevent the lid 3 from being lifted.

Figure 12C:
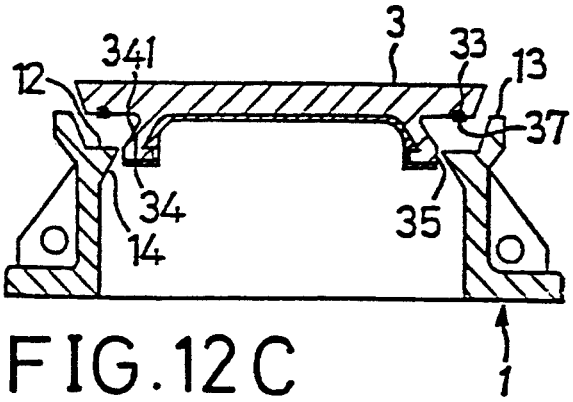
Figure 12D:
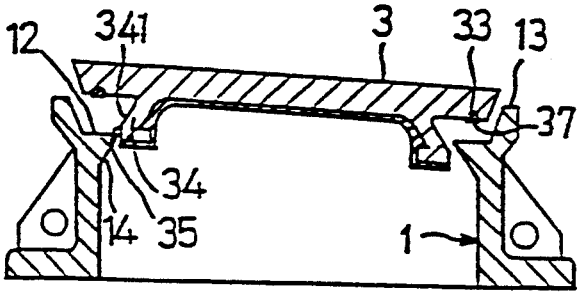

As shown in FIG. 12C, assuming the lid 3 is lifted to a certain height by a vertical force and slanted before it completely comes out of the annular supporter 12 of the ring seat 1, the vertical retaining part 34 at the lower outer end of the splayed rib ring 34 would still be retained by the bevelled underside 14. As shown in FIG. 12D, to completely lift the lid 3 out of the annular supporter 12 without being retained by the same, the assumed vertical force must not be interrupted by any stable or unstable lateral force for a certain period of time. In an actual situation in which vehicles usually run over and pass a manhole lid at high speed, this assumed uninterrupted vertical force does not exist. To increase the time needed to completely lift the lid 3 out of the annular supporter 12 or to offset any outward vertical force applied to the lid 3, the depth of the splayed rib ring 34 may be increased depending on actual need.

Please refer back to FIG. 6. The manhole having an eccentric annular supporter 12, provides a much more enhanced effect in preventing the lid 3 from bouncing out of place, in addition to the aforesaid advantages. In this embodiment, when the lid 3 is on the ring seat 1, a large part of the splayed rib ring 34 of the lid 3 is retained by the bevelled underside 14 at the larger width annular supporter side 12A to effectively offset any vertical bounce of the lid 3. From the description about the closing and removal of the lid 3 to and from an eccentric annular supporter 12 together with the illustration in FIGS. 11A, B, and C, it can be seen that two forces applied to the lid 3 at different times and in different directions (first an upward vertical force and then a diagonal force) are required. That is, any single force in one direction would not be enough to lift and remove the lid 3.

2. Noise is eliminated.

Please refer to FIGS. 3, 6 and 9. The half round groove 33 provided near the periphery of the lid 3 accommodates an elastic rubber gasket 37 which forms a buffer between the lid 3 and the annular supporter 12 where the lid 3 is located. The lid 3, therefore, does not directly contact the annular supporter 12, and any bounce or vibration of the lid 3 is absorbed by the rubber gasket 37 thereby eliminating any possible noise.

3. Possible leakage is avoided.

Please refer to FIGS. 2, 5, and 8. The molded one-piece plastic- or rubber insulation hood 2 attached to the underside of the lid 3 is specially designed to form a complete insulation layer under the lid 3. Even if cables under the manhole are worn out for a reason, they would not directly contact the lid 3 because of the insulation hood 2. Under the circumstances, no leakage will occur to endanger the safety of walkers passing by. 4. Costs for manufacture, inspection and acceptance, transportation, and storage of manhole lids and ring seats are reduced.

Due to the special structural design, the precision required for a minimum gap between the splayed rib ring 34 and the ring seat 1 can be lowered during manufacture. Accordingly, the lids 3 and the ring seat 1 can be separately manufactured, transported, inspected and stored. In this manner, the handling costs originally required for a higher standard of precision can be saved. 5. Difficulties in maintenance are resolved.

Since the lid 3 and the ring seat 1 provided by the present invention can be used separately, any broken or damaged lid 3 can be replaced by any other at any time without concern about a mismatch in size. 6. The weight of a manhole lid can be reduced.

Since the manhole according to the present invention is designed to prevent the lid 3 from bouncing out of place, the only consideration to take into account in the design is the necessary load strength required by the lid 3. The weight of the lid itself is not an important factor in preventing its bouncing. Therefore, the weight of the lid 3 may be reduced and the selection of materials for making lid 3 is less restricted. The possible difficulty in closing or removing the lid 3 can be eliminated. 7. Conventional structural design for manually opening the lid can still be used in the present invention.

For manhole with an eccentric annular supporter, the lid 3 can be closed or removed manually without using bulky and heavy mechanical devices for the same purpose, provided the steps for closing or removing the lid 3 from one arrow-indicated side is followed.

From the above, it can be seen that the manhole according to the present invention is structurally solid but simplified to facilitate the opening and closing of the lid, and can effectively prevent possible damage to vehicles and walkers, as well as undesirable noise caused by the bounce of the lid 3.

However, it is to be understood that the form of the present invention shown and disclosed is to be taken as a preferred embodiment of the invention and that various changes in the shape, size and arrangement of parts may be resorted to without departing from the spirit of the invention or the scope of subjoined claims.

What is claimed is:

1. A manhole comprising: a lid having a splayed rib ring extending therefrom and defining a half round circular groove adapted to receive an elastic rubber gasket as its underside; an insulation hood attached to an inner side of said splayed rib ring; and a ring seat having an annular supporter with a beveled underside.

2. A manhole as claimed in claim 1, wherein said splayed rib ring further comprises a vertical retaining part located at an outer side of a lower end, such that said splayed rib ring is retained and located by said beveled underside of the annular supporter after said lid is set onto said ring seat.

3. A manhole as claimed in claim 1 wherein said insulation hood completely covers an inside of said splayed rib ring to prevent any possible leakage caused by a worn cable directly contacting said manhole lid.

4. A manhole as claimed in claim 3, wherein said splayed rib ring further comprises a laterally and inwardly extending flange at a lower end adapted to hold said insulation hood.

5. A manhole as claimed in claim 1, wherein said half round groove is formed adjacent a periphery of said lid and further comprising an elastic rubber gasket in said groove such the gasket is interposed between said lid and said annular supporter thereby preventing direct contact between said lid and said annular supporter.

6. A manhole as claimed in claim 1, wherein said annular supporter of said ring seat comprises a bevelled underside which extends upward and inward from an inner periphery of said ring seat to a top surface of said annular supporter.

7. A manhole as claimed in claim 1, wherein circular splayed rib ring is circular and has an outer diameter smaller than an inner diameter of said annular supporter, and wherein said splayed rib ring comprises an outer splayed surface extending substantially parallel to said bevelled underside of said annular supporter such that said splayed rib ring is retained by said bevelled underside of said annular supporter without bounding upward whenever said lid is laterally moved or slanted.

8. A manhole as claimed in claim 1, wherein said splayed rib ring is not concentric with said lid and wherein said annular supporter is not concentric with said ring seat.

9. A manhole as claimed in claim 1, wherein said splayed rib ring and said annular supporter are elliptical in configuration.

* * * * *